US010780712B2

(12) United States Patent
Yamasaki

(10) Patent No.: US 10,780,712 B2
(45) Date of Patent: Sep. 22, 2020

(54) DRAWING APPARATUS, METHOD OF DRAWING, AND RECORDING MEDIUM

(71) Applicant: CASIO COMPUTER CO., LTD., Shibuya-ku, Tokyo (JP)

(72) Inventor: Shuichi Yamasaki, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 109 days.

(21) Appl. No.: 15/902,994

(22) Filed: Feb. 22, 2018

(65) Prior Publication Data

US 2018/0272751 A1 Sep. 27, 2018

(30) Foreign Application Priority Data

Mar. 21, 2017 (JP) ..... 2017-054010

(51) Int. Cl.

| | |
|---|---|
| ***B41J 2/175*** | (2006.01) |
| ***B41J 3/407*** | (2006.01) |
| ***A45D 29/00*** | (2006.01) |
| ***B41J 11/00*** | (2006.01) |

(52) U.S. Cl.

CPC ..... *B41J 3/407* (2013.01); *A45D 29/00* (2013.01); *B41J 3/4073* (2013.01); *B41J 11/0095* (2013.01); *A45D 2029/005* (2013.01)

(58) Field of Classification Search

None

See application file for complete search history.

(56) References Cited

U.S. PATENT DOCUMENTS

| | | | | |
|---|---|---|---|---|
| 5,931,166 | A | 8/1999 | Weber et al. | |
| 6,067,996 | A | 5/2000 | Weber et al. | |
| 6,286,517 | B1 | 9/2001 | Weber et al. | |
| 6,525,724 | B1 * | 2/2003 | Takami | A45D 29/00 345/418 |
| 8,814,289 | B2 | 8/2014 | Yamasaki | |
| 2012/0274683 | A1 * | 11/2012 | Yamasaki | B41J 3/4073 347/2 |
| 2012/0287183 | A1 * | 11/2012 | Bitoh | A45D 29/00 347/3 |
| 2014/0060560 | A1 * | 3/2014 | Bitoh | A45D 29/00 132/73 |

FOREIGN PATENT DOCUMENTS

| | | | |
|---|---|---|---|
| CN | 102756557 | A | 10/2012 |
| JP | 2003534083 | A | 11/2003 |
| JP | 2012232414 | A | 11/2012 |
| JP | 2015150771 | A | 8/2015 |

OTHER PUBLICATIONS

Chinese Office Action dated Jun. 5, 2019 (and English translation thereof) issued in counterpart Chinese Application No. 201810235115.7.

Japanese Office Action (and English language translation thereof) dated Jan. 7, 2020 issued in counterpart Japanese Application No. 2017-054010.

* cited by examiner

*Primary Examiner* — Erica S Lin

(74) *Attorney, Agent, or Firm* — Holtz, Holtz & Volek PC

(57) ABSTRACT

A drawing apparatus includes a drawing head drawing a pattern on the surface of a target nail of a hand or foot; and a processor. The processor controls the drawing head to scan a plurality of times across an area on the surface of the nail and to draw the pattern on the area during each of the plurality of scanning operations of the drawing head based on a curvature of the nail.

8 Claims, 7 Drawing Sheets

| POSITION | D1 | D2 | D3 | D4 | D5 | D6 | D7 | D8 | D9 | D10 | D11 | D12 | D13 | D14 | D15 | D16 | D17 |
|---|---|---|---|---|---|---|---|---|---|---|---|---|---|---|---|---|---|
| CURVATURE 5 | 1 | 2 | 2 | 2 | 2 | 2 | 3 | 3 | 3 | 3 | 3 | 3 | 4 | 4 | 4 | 4 | 4 |
| CURVATURE 4 | 1 | 1 | 2 | 2 | 2 | 2 | 2 | 2 | 2 | 2 | 3 | 3 | 3 | 3 | 4 | 4 | 4 |
| CURVATURE 3 | 1 | 1 | 1 | 1 | 2 | 2 | 2 | 2 | 2 | 2 | 2 | 3 | 3 | 3 | 3 | 3 | 4 |
| CURVATURE 2 | 1 | 1 | 1 | 1 | 1 | 1 | 2 | 2 | 2 | 2 | 2 | 2 | 2 | 2 | 3 | 3 | 3 |
| CURVATURE 1 | 1 | 1 | 1 | 1 | 1 | 1 | 1 | 1 | 1 | 1 | 2 | 2 | 2 | 2 | 2 | 2 | 3 |

Ar_N | Ar_R

| POSITION | d0 | d1 | d2 | d3 | d4 | d5 | d6 |
|---|---|---|---|---|---|---|---|
| CORRECTION FACTOR | 1 | 2 | 2 | 2 | 3 | 3 | 4 |

FIG.6
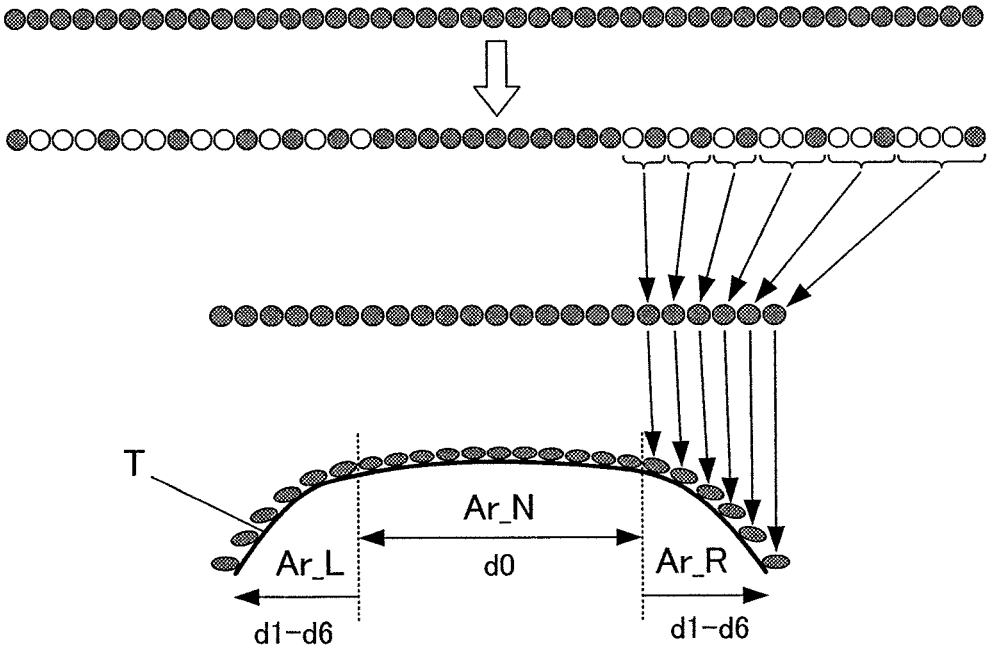
FIG.7A
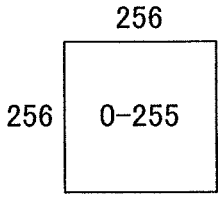
FIG.7B
| CORRECTION FACTOR | 1 | 2 | 3 | 4 |
|---|---|---|---|---|
| FIRST SCANNING OPERATION | 0-63 | 0-127 | 0-127 | 0-255 |
| SECOND SCANNING OPERATION | 64-127 | 128-255 | 128-255 | 0-255 |
| THIRD SCANNING OPERATION | 128-191 | 0-127 | 0-255 | 0-255 |
| FOURTH SCANNING OPERATION | 192-255 | 128-255 | 0-255 | 0-255 |

DRAWING APPARATUS, METHOD OF DRAWING, AND RECORDING MEDIUM

BACKGROUND OF THE INVENTION

1. Field of the Invention

The present invention relates to an apparatus and a method of drawing, and a recording medium.

2. Description of the Related Art

A nail drawing apparatus or nail printer is known that draws any designs chosen by a user on finger nails of the user (for example, Japanese Translation of PCT International Application Laid-Open No. 2003-534083).

Users can readily enjoy nail print with such an apparatus without visiting nail salons.

Human nails, which are the target of a nail printer, have an overall round and curved shape in which the right and left edges in the width direction are sunken and the central area is bulged.

Thus, the image (nail design) to be drawn may have varying print density or may be stretched or distorted depending on the tilt of the surface at the edges of the nail.

Drawing an image on a nail without such a variation in print density or stretching and distortion requires curved surface correction on the data of the image to be drawn, satisfactory resolution at the end regions of the nail in the width direction, and appropriate decimation of the data of regions without curved surface correction. To achieve such a drawing, the resolution of the entire nail surface including an area without curved surface correction, i.e., the relatively flat central area of the nail in the width direction, should be matched with the resolution of the end regions of the nail in the width direction, which receives curved surface correction. This causes an increase in volume of the image data compared to that of image data without curved surface correction. Thus, the memory for storing the image data for drawing with curved surface correction must have a large size compared to that without curved surface correction.

BRIEF SUMMARY OF THE INVENTION

An object of the present invention is to provide a drawing apparatus, a method of drawing, and a recording medium that can advantageously draw patterns on a nail with stable print density, without distortion at the end regions of the nail in the width direction, and without an increase in the volume of the drawing data.

According to an embodiment of the present invention, a drawing apparatus includes: a drawing head drawing a pattern on a surface of a target nail of a finger or toe; and a processor, wherein the processor controls the drawing head to scan a plurality of times across an area on the surface of the nail and to draw the pattern on the area during each of the plurality of scanning operations of the drawing head based on a curvature of the target nail.

According to an embodiment of the present invention, a method of drawing a pattern on the surface of a target nail of a finger or a toe using a drawing apparatus having a drawing head includes: performing a first control including controlling the drawing head to scan a plurality of times across an area on the surface of the target nail; and performing a second control including controlling the drawing head whether or not to draw the pattern on the area during each of the plurality of scanning operations based on the curvature of the target nail.

According to an embodiment of the present invention, a non-transitory readable recording medium storing a program for a drawing apparatus including a drawing head, causing a processor of the drawing head to execute a process of: controlling the drawing head to scan a plurality of times across an area on the surface of a nail and to draw a pattern on the area during each of the plurality of scanning operations in accordance with the curvature of the nail.

BRIEF DESCRIPTION OF THE SEVERAL VIEWS OF THE DRAWING

FIG. 6 is a schematic view of shape correction conducted on image data of a nail design.

FIG. 7A illustrates an example unit region. FIG. 7B illustrates an example jet control table.

DETAILED DESCRIPTION OF THE INVENTION

A nail printer 1 or nail drawing apparatus and a method of drawing a pattern with the nail printer or nail drawing apparatus according to embodiments of the present invention will now be described with reference to FIGS. 1 to 11.

The following embodiments involve various technically preferred limitations for accomplishing the present invention. The scope of the invention, however, should not be limited to the embodiments and drawings.

The target of the nail printer 1 according to the embodiments described below is the surface of a nail of a finger. The target of the present invention may be any other surface, for example, the surface of a nail of a toe.

Figure 1B:
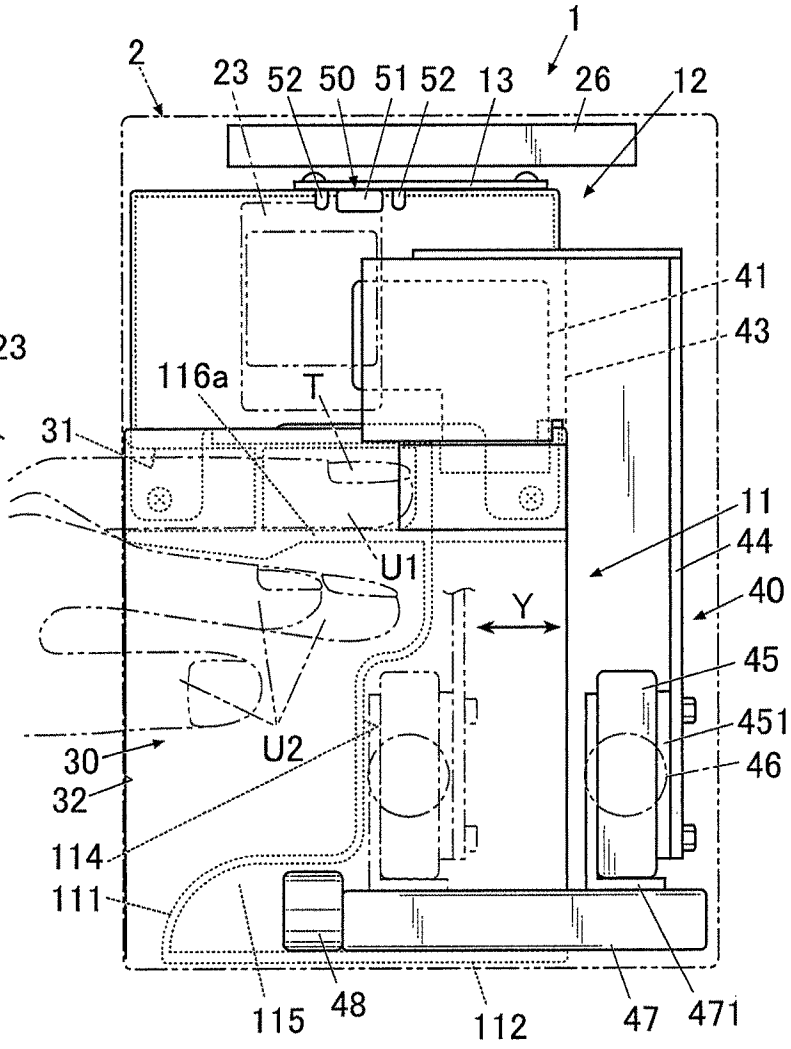
FIG. 1B is a side view of the internal configuration of the drawing apparatus illustrated in FIG. 1A.
Figure 1A:
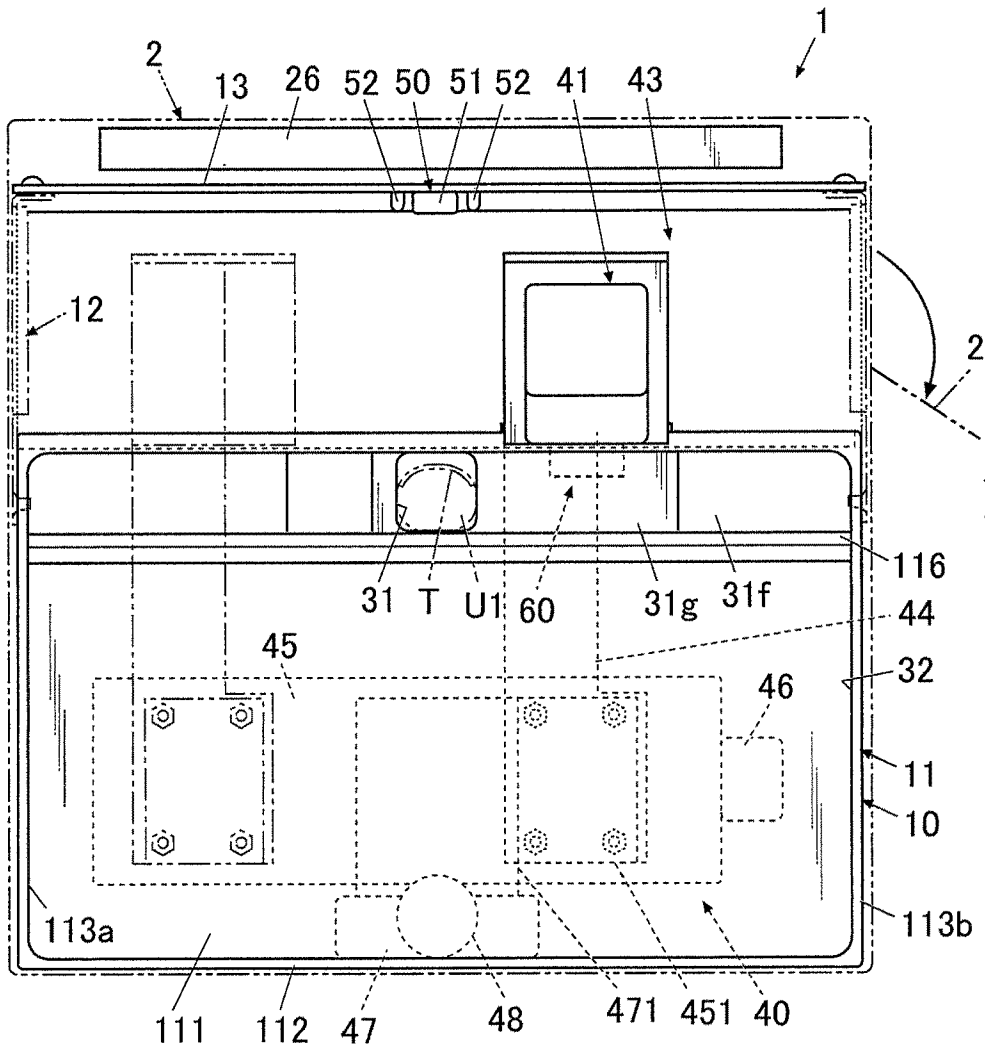
FIG. 1A is a front view of a drawing apparatus according to an embodiment.

FIG. 1A is a front view of the internal configuration of a nail printer 1. FIG. 1B is a side view of the internal configuration of the nail printer 1 illustrated in FIG. 1A.

With reference to FIGS. 1A and 1B, the nail printer 1 according to this embodiment includes a drawing unit 40 including a drawing head 41 as a drawing tool. The nail printer 1 is an inkjet printer that draws a pattern on a nail T of a target finger U1.

The nail printer 1 includes a case 2 and a body 10 disposed in the case 2.

A cover 23 that can be opened for replacement of the drawing head 41 of the drawing unit 40 is disposed at the upper end of a side face of the case 2. The cover 23 turns from a closed position to an open position, as illustrated in FIG. 1, for example, around a hinge.

An operating unit 25 (see FIG. 2) is disposed on the upper face or top panel of the case 2.

The operating unit 25 is an input unit operated by the user to enter various input operations.

The operating unit 25 includes, for example, a power button for turning on the power of the nail printer 1, a stop button for stopping the operation of the nail printer 1, a design selection button for selecting a design to be drawn on the nail T, a drawing button for instructing the start of drawing, and an operating button (not shown) for entering various input operations.

A display 26 is disposed in the central area of the upper face or top panel of the case 2.

The display 26 is a flat display, for example, a liquid crystal display (LCD) or an organic electroluminescent display.

In this embodiment, the display 26 appropriately displays, for example, a nail image (an image of the target finger U1 including the nail T) acquired by capturing an image of the target finger U1, an image of the outline of the nail T included in the nail image, a design selection menu for selecting the design of the image to be drawn on the nail T, a thumbnail image for confirming the design, and an instruction menu for displaying various instructions.

The surface of the display 26 may be integrated with a touch panel for receiving various input operations.

The body 10 has a shape of a substantial box. The body 10 includes a lower casing 11 disposed inside the case 2 in the lower area and an upper casing 12 disposed inside the case 2 in the upper area above the lower casing 11.

The lower casing 11 will now be described.

The lower casing 11 includes a back panel 111, a bottom panel 112, right and left side panels 113*a* and 113*b*, an X-shifting-stage case 114, a Y-shifting-stage case 115, and a partition 116.

The bottom edges of the side panels 113*a* and 113*b* are connected to the left and right edges of the bottom panel 112, respectively, such that the side panels 113*a* and 113*b* are in a standing position with respect to the bottom panel 112.

The lower portion of the back panel 111 sinks in two steps toward the front in the direction fingers are to be inserted. The lower portion of the back panel 111 is connected to the front edge of the bottom panel 112. The back panel 111 partitions the space defined by the bottom panel 112 and the side panels 113*a* and 113*b* into front and rear compartments. The space defined behind the depressed back panel 111 serves as the X-shifting-stage case 114 and the Y-shifting-stage case 115 (see FIG. 1B). The X-shifting-stage case 114 accommodates an X-shifting stage 45 of the drawing unit 40 while the drawing unit 40 shifts forward in the direction fingers are to be inserted. The Y-shifting-stage case 115 accommodates a Y-shifting stage 47 of the drawing unit 40.

The partition 116 is disposed inside the lower casing 11 to partition the space in the inner front side of the lower casing 11 (the space defined by the back panel 111, the bottom panel 112, and the side panels 113*a* and 113*b* at the front in the direction fingers are to be inserted) into upper and lower compartments. The partition 116 is substantially horizontally disposed. The left and right edges of the partition 116 are connected to the side panels 113*a* and 113*b*, respectively. The rear end portion of the partition 116 is connected to the back panel 111.

The lower casing 11 is integrated with a finger holder 30 (see FIG. 1B). The finger holder 30 includes a finger receiver 31 that receives the finger corresponding to the target nail T on which an image is drawn (this finger is hereinafter referred to as "target finger U1") and a finger space 32 where the fingers other than the target finger U1 (which are hereinafter referred to as "non-target fingers U2") are placed.

The finger receiver 31 is disposed above the partition 116 and in the substantial middle of the lower casing 11 in the width direction. The lower compartment of the lower casing 11 partitioned by the partition 116 defines the finger space 32.

For example, to draw an image on the nail T of the ring finger, the ring finger or target finger U1 is inserted into the finger receiver 31 and the other four digits or non-target fingers U2 (thumb, index finger, middle finger, and little finger) are inserted into the finger space 32.

With reference to FIGS. 1A and 1B, the finger receiver 31 is an opening in the front face (in the direction fingers are to be inserted) of the lower casing 11. The bottom of the finger receiver 31 is partitioned by a finger rest 116*a*, which is a portion of the partition 116. The target finger U1 having the target nail T is placed on the finger rest 116*a* in the XY plane.

The finger receiver 31 has a window (not shown) at the top to expose the nail T of the target finger U1 inserted into the finger receiver 31.

Front walls 31*f* (see FIG. 1A) blocking the front face of the lower casing 11 are vertically disposed on the upper face of the partition 116 at the two ends of the front face of the lower casing 11. A pair of guiding walls 31*g* (see FIG. 1A) is vertically disposed on the upper face of the partition 116. The guiding walls 31*g* define a space that tapered from the central areas of the front walls 31*f* toward the finger receiver 31 to guide the target finger U1 into the finger receiver 31.

The user can pinch the partition 116 with the target finger U1 in the finger receiver 31 and the non-target fingers U2 in the finger space 32. This stabilizes the target finger U1 disposed in the finger receiver 31.

A home area 60 for holding the drawing head 41 during a standby mode is provided adjacent to the finger receiver 31 (on the right in FIG. 1A) on the upper face of the lower casing 11 within the movable region of the drawing head 41 described below.

An inkjet maintenance unit is disposed in the home area 60 facing the drawing head 41 disposed in the home area 60 during the standby mode. The inkjet maintenance unit includes, for example, a cleaning mechanism (not shown) for cleaning the ink jet (nozzle face) of the drawing head 41 and a cap mechanism (not shown) for maintaining a moist state of the ink jet (nozzle face).

The inkjet maintenance unit may be disposed at any other position in the home area.

The drawing unit 40 includes a drawing head 41, a support 44 that supports the drawing head 41, an X-shifting stage 45 that shifts the drawing head 41 in the X or right-left direction of the nail printer 1 in FIG. 1A, an X-direction shift motor 46, a Y-shifting stage 47 that shifts the drawing head 41 in the Y or front-back direction of the nail printer 1 in FIG. 1B, and a Y-direction shift motor 48.

The drawing head 41 is supported by a head holder 43 and disposed on the support 44 according to this embodiment.

The drawing head 41 is of an integrated cartridge type that includes ink cartridges (not shown), for example, for yellow (y), magenta (M), and cyan (C) inks integrated with ink jets (not shown) disposed on a plane facing the nail T (the lower face in this embodiment illustrated in FIG. 1A) on which a pattern is to be drawn. The ink jet includes nozzle arrays each including multiple nozzles that jet different color inks. The drawing head 41 jets microdroplets of ink from the ink jet directly onto the drawing surface of the target nail T to draw a pattern. The nozzles jetting inks each include a piezoelectric device (not shown). The jet of the ink from each nozzle is independently controlled through a drawing control process executed by a processor 81 described below.

The drawing head 41 may jet ink of any color besides the three colors mentioned above. Other ink cartridges and ink jets for other colors of ink may also be provided.

The nozzles of the drawing head 41 may have any configuration that can independently control the ink jet, besides that including piezoelectric devices.

For example, the nozzles may each include heaters for thermal nozzle control.

The support 44 is fixed to a X-direction shifter 451 fixed to the X-shifting stage 45. The X-direction shifter 451 shifts in the X direction along a guide (not shown) on the X-shifting stage 45 by the driving force of the X-direction shift motor 46. This shifts the drawing head 41 fixed to the support 44 in the X or right-left direction of the nail printer 1 in FIG. 1A.

The X-shifting stage 45 is fixed to a Y-direction shifter 471 of the Y-shifting stage 47. The Y-direction shifter 471 shifts in the Y direction along a guide (not shown) on the Y-shifting stage 47 by the driving force of the Y-direction shift motor 48. This shifts the drawing head 41 fixed to the support 44 in the Y or front-back direction of the nail printer 1 in FIG. 1B. In this embodiment, the X-shifting stage 45 is an assembly of the X-direction shift motor 46, ball screws, and a guide (not shown), and the Y-shifting stage 47 is an assembly of the Y-direction shift motor 48, ball screws, and a guide (not shown).

In this embodiment, the X-direction shift motor 46 and the Y-direction shift motor 48 constitute an XY driver or head shifter 49 that drives the drawing head 41 in the X and Y directions.

The drawing head 41, the X-direction shift motor 46, and the Y-direction shift motor 48 of the drawing unit 40 are connected to the processor 81 of a controller 80 described below and are controlled under a drawing control process executed by the processor 81.

An image capturing unit 50 includes an image capturing device 51 and lighting devices 52.

The lighting devices 52 of the image capturing unit 50 illuminate the nail T and the target finger U1 inserted in the finger receiver 31 and exposed through the window. The image capturing device 51 captures an image of the target finger U1 and acquires a nail image or an image of the target finger U1 including the nail T.

The image capturing device 51 and the lighting devices 52 according to this embodiment are disposed on the upper casing 12, as illustrated in FIGS. 1A and 1B.

In detail, the image capturing device 51 and the lighting devices 52 of the image capturing unit 50 are disposed on the bottom face of a substrate 13 disposed on the upper casing 12 so as to face the partition 116.

The image capturing device 51 and the lighting devices 52 may be disposed at any position other than those illustrated in the drawings on the substrate 13.

The image capturing device 51 is, for example, a compact image capturing device including a solid-state image sensor provided with approximately 2 million or more pixels and a lens.

In this embodiment, the image capturing device 51 of the image capturing unit 50 captures a nail image or an image of the target finger U1 including the nail T.

The nail-information selecting process described below detects the positions and shapes or outlines of the target finger U1 and the target nail T, and the aspect ratio of the nail T in the nail image.

The lighting devices 52 are, for example, white LEDs.

In this embodiment, four lighting devices 52 are disposed on the right, left, front, and back of the image capturing device 51 so as to surround the image capturing device 51. The lighting devices 52 emit light downward to illuminate the image-capturing area beneath the image capturing device 51.

Any number of lighting devices 52 may be disposed at any positions besides those illustrated in the drawings.

The image capturing unit 50 is connected to the processor 81 (see FIG. 2) of the controller 80 described below and controlled by the processor 81.

Image data of nail images captured by the image capturing unit 50 is stored in a nail-image memory area 821 of a memory 82 described below.

The controller 80 is, for example, disposed on the substrate 13 on the upper casing 12.

Figure 2:
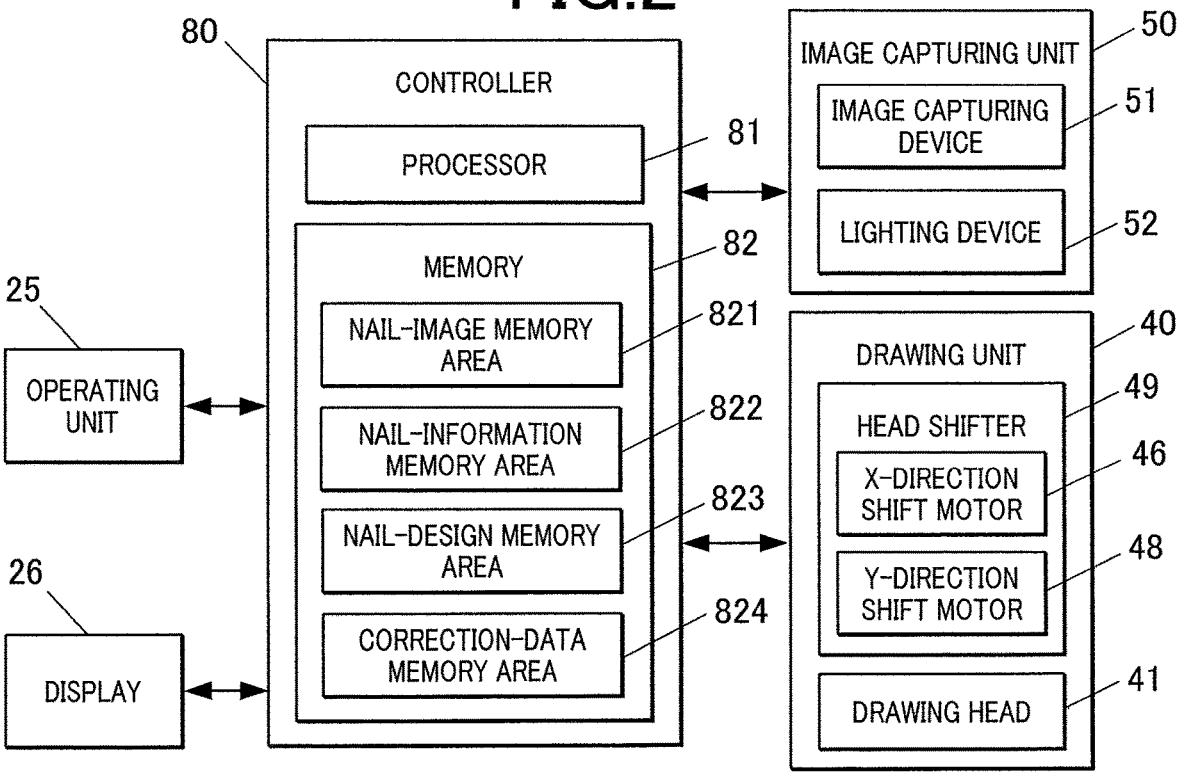
FIG. 2 is a block diagram of essential components of the control configuration of the drawing apparatus according to an embodiment.

FIG. 2 is a block diagram of essential components of the control configuration according to this embodiment.

With reference to FIG. 2, the controller 80 is a computer including a processor 81 and a memory 82, where the processor 81 includes a central processing unit (CPU) (not shown), and the memory 82 includes a read only memory (ROM) and a random access memory (RAM) (both not shown).

The memory 82 stores various programs and data items for operating the nail printer 1.

In detail, the ROM of the memory 82 stores programs, such as a nail-information detecting program for detecting the position and shape or outline of the target finger U1, the position and shape or outline of the nail T, and the aspect ratio and other parameters of the nail T, a drawing-data generating program for generating drawing data from image data on a nail design subjected to curved surface correction, and a drawing program for executing a drawing process. These programs are executed by the controller 80 to comprehensively control the components of the nail printer 1.

The memory 82 according to this embodiment includes a nail-image memory area 821 storing nail images of the nail T of the target finger U1 captured by the image capturing unit 50, a nail-information memory area 822 storing nail information (which includes the outlines of the target finger U1 and the nail T and the aspect ratio of the nail T) detected through the nail-information detecting process executed by the processor 81, a nail-design memory area 823 storing image data (also referred to as "design data") on nail designs to be printed on the target nail T, and a correction-data memory area 824 storing data required for curved surface correction on the drawing data executed by the processor 81 through a drawing-data generating process.

The processor 81 executes an imaging control process, a nail-information detecting process, a drawing-data generating process, a drawing control process, and a display controlling process. The CPU of the processor 81 operates to function as an imaging controller, a nail-information detector, a drawing-data generating process unit, a drawing controller, or a display controller in cooperation with the programs stored in the ROM of the memory 82.

The processor 81 executes the imaging control process to control the image capturing device 51 and the lighting devices 52 of the image capturing unit 50 and capture an image of the target finger U1 placed in the finger receiver 31 (hereinafter, an image of the target finger U1 including the nail T is referred to as "nail image") with the image capturing device 51.

Image data on the nail image captured by the image capturing unit 50 is stored in the nail-image memory area 821 of the memory 82.

Detection of nail information including the outlines of the target finger U1 and the nail T and the aspect ratio of the nail T in a nail image captured by the image capturing unit 50 will now be explained. The nail information detected in a nail image may be any other information, for example, the curvature of the nail T.

The nail-information detecting process executed by the processor 81 detects the outline of the finger defining the area of the target finger U1, the outline or shape of the nail T defining the area of the target nail T, and the curvatures indicating the curvature of the target nail T in the width direction, in a nail image including the target finger U1 including the nail T captured by the image capturing device 51 of the image capturing unit 50.

Nail information including the shapes or outlines of the target finger U1 and the nail T is detected through the nail-information detecting process on the basis of, for example, the color difference between the target finger U1 and nail T and the background (the finger rest 116*a* in this embodiment). The boundary between the nail T and the skin of the target finger U1 is detected on the basis of the color difference between the nail T and the target finger U1 and/or the shades to determine the shape or outline of the nail T.

In the case where the image capturing unit 50 captures a plurality of nail images by capturing operations while the lighting devices 52 emits light in a different angle during each capturing operation, the nail-information detecting process executed by the processor 81 determines the curvature of the nail T in the width direction on the basis of the darkness of the shades appearing in the nail image. The curvature includes information corresponding to the curvature of positions at predetermined intervals in the horizontal direction of the surface of the nail T, i.e., the tilt of the surface of the nail T to the horizontal direction, as illustrated in FIG. 4 described below.

The nail information may be detected through any other method besides the method of detecting nail information through the nail-information detecting process explained above. The curvature is determined through the nail-information detecting process. Alternatively, the curvature may be determined through any other means, for example, the curvature may be preliminarily set to a standard value that is variable by the user.

Figure 3:
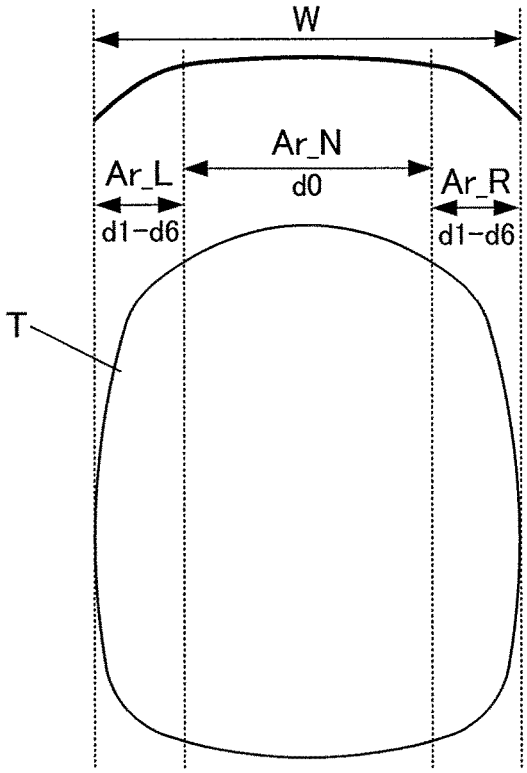
FIG. 3 is a plan view of an example nail that is a target of drawing.

FIG. 3 is a schematic view of the target nail T.

FIG. 3 includes a top plan view of the surface of the target nail T and a front view of the nail T from the tip of the nail T, where w is the apparent width of the surface of the nail viewed from the top.

The area "Ar_N" is the relatively flat central area of the nail in the width direction that requires no curved surface correction, and the left end area "Ar_L" and the right end area "Ar_R" are curved areas requiring curved surface correction and respectively reside on the left and right ends of the nail in the width direction. The areas "Ar_L" and "Ar_R" requiring curved surface correction each have a width of approximately 3 mm. The width of the areas "Ar_L" and "Ar_R" can be preliminarily determined as a default value or may vary depending on the curvature of the nail T.

Figures 4A, 4B, 5:
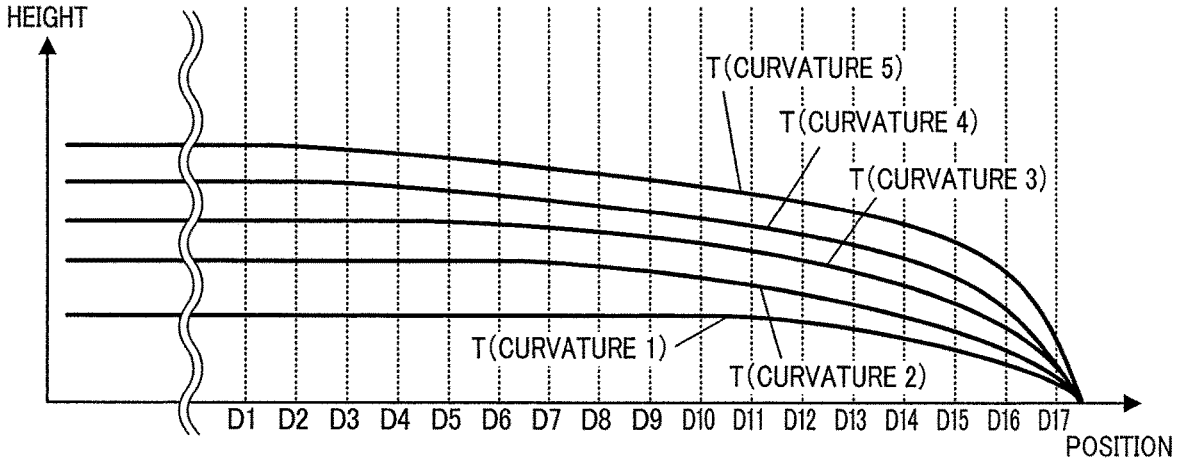
FIG. 4A illustrates the curvatures and the correction factors corresponding to the curvatures.
FIG. 4B illustrates images of nails having different curvatures.
FIG. 5 illustrates the correspondence between positions at the edge of the nail and the correction factors.

The nail-information detecting process executed by the processor 81 may precisely detect the curvature of each nail T. Alternatively, in this embodiment, a table containing correction factors in correlation with curvatures of five levels based on curvatures of the nail T, i.e., different tilts of the surface of the nail T to the horizontal direction, at positions in the end regions of the nail T at predetermined intervals in the horizontal direction is stored in the correction-data memory area 824, as illustrated in FIG. 4A. The nail-information detecting process executed by the processor 81 determines one of the curvatures that is closest to the actual curvature of the nail T and classify it into the curvatures "1" to "5."

Curvatures "1" to "5" are defined as illustrated in FIG. 4B, where the curvature "1" corresponds to an overall flat surface of the nail T having a relatively small curvature, the curvature "5" corresponds to a curved surface of the nail T having a relatively large curvature, and the curvature "3" corresponds to the surface of a typical nail T having an intermediate curvature. Correction factors "1" to "4" are determined as illustrated in FIG. 4A for each curvature from one end to the other end of the nail along the width direction of the nail. The columns of the table in FIG. 4A correspond to positions D1 to D17 at the predetermined intervals at the end regions of the nail T, as illustrated in FIG. 4B.

FIG. 4B illustrates example curvatures within an area from the right end region in the width direction of the nail T corresponding to the respective curvatures. FIG. 4A illustrates the correction factors for the positions having respective curvatures, substantially aligned with the positions illustrated in FIG. 4B.

The values "1" to "4" in FIG. 4A respectively correspond to the correction factors "1" to "4" in FIG. 5 described below.

The drawing-data generating process executed by the processor 81 generates data required for printing a nail design on the nail T of the target finger U1 by the drawing head 41.

In this embodiment, the drawing-data generating process generates wide image data by expanding the design data of the nail design to be printed on the nail T in the width direction of the nail T in accordance with the curvature determined in the nail-information detecting process.

The image data for drawing is generated through the shape correction of the wide image data by compressing a portion of the data corresponding to the two end regions of the nail in the width direction in accordance with the curvature and matching the compressed data to the two-dimensional shape of the nail T.

The shape correction of the design data under the drawing-data generating process executed by the processor 81 will now be explained in detail with reference to FIGS. 5 and 6. In FIGS. 5 and 6, the intervals between the positions corresponding to respective correction factors in the end regions of the target nail T are increased compared to those in FIGS. 4A and 4B to simplify the curved shape of the nail into positions d0 to d6, although FIGS. 5 and 6 actually apply to a curved nail having a curved shape approximating the curvature "3" in FIGS. 4A and 4B.

FIG. 5 illustrates an example table illustrating the correspondence between the positions d0 to d6 in an end region of the nail T and the correction factors at the respective positions.

The positions d0 to d6 in FIG. 5 are the same as the positions d0 to d6 in FIGS. 3 and 6. In specific, the positions d1 to d6 correspond to both areas "Ar_L" and "Ar_R" that require curved surface correction, where the position d6 corresponds to the outermost positions in the left and right end regions in the width direction of the nail having the largest curvature, and the position d1 corresponds to the innermost positions in the areas "Ar_L" and "Ar_R," closest to the area "Ar_N." The position d0 corresponds to the area "Ar_N" that requires no curved surface correction.

In the table in FIG. 5, the correction factor "1" in correlation with the position d0 indicates no curved surface correction, whereas the positions d1 to d6 in correlation with the corrections factors "2" to "4," respectively, indicate double to quadruple levels of correction.

In the areas "Ar_L" and "Ar_R" illustrated in FIGS. 5 and 6, the outermost position d6 corresponds to a correction factor "4," the positions d4 and d5 correspond to a correction factor "3," and the positions d1 to d3 correspond to a correction factor "2." The position d0 in the area "Ar_N" that requires no curved surface correction corresponds to a correction factor "1" indicating no curved surface correction.

The drawing-data generating process executed by the processor 81 acquires the curvatures of the surface of the nail T, retrieves and refers to a table as illustrated in FIG. 5 from the correction-data memory area 824 to assign correction factors corresponding to the curvatures to the design data on the nail design, to generate wide image data illustrated at the top of FIG. 6.

The wide image data is generated by expanding the design data by one time at the positions corresponding to the correction factor "1" and by four times at the positions corresponding to the correction factor "4" in the width direction of the nail T.

The drawing-data generating process executed by the processor 81 generates image data for drawing from the wide image data in reference to the table referred to in generating the wide image data (i.e., the table illustrated in FIG. 5 in this embodiment).

In detail, the data of the outermost regions in the width direction of the nail corresponding to the correction factor "4" is decimated to one fourth in size, data corresponding to the correction factor "3" is decimated to one third in size, and data corresponding to the correction factor "2" is decimated to one second in size. The removed data items are indicated by white circles in the second row from the top of FIG. 6.

The data on the pattern to be drawn is allocated on the surface of the target nail T after appropriate decimation in accordance with the correction factors, to generate shape-corrected image data for drawing that is compressed in accordance with the curvatures at the two end regions of the nail in the width direction, as illustrated in the third row from the top in FIG. 6, and matched to the two-dimensional shape, i.e., the shape of the top plan view of the nail T as illustrated in bottom region of FIG. 3.

In this way, the design data can be subjected to shape correction suitable for the curvature of the nail T to achieve uniform print on the entire surface of the nail T including the two end regions, as illustrated in the bottom row in FIG. 6.

Unfortunately, in the state illustrated in the bottom row in FIG. 6, the density of the ink dots printed on the two end regions of the nail T is low compared to those in the central region of the nail T and causes a reduction in the printing density.

The drawing-data generating process executed by the processor 81 generates jet control data corresponding to the image data for drawing, where the jet control data determines the driving state of the nozzles during a plurality of scanning operations of the drawing head 41 on the basis of the curvatures.

FIG. 7A illustrates a unit region consisting of 256×256 mask patterns. Print of such a unit region through four scanning operations will now be explained. Dot data items 0 to 255 respectively having values of 0 to 255 are uniformly dispersed across the unit region consisting of the mask patterns. For example, in order to print the unit region in four scanning operations in the drawing-data generating process, the dot data items 0 to 255 are categorized into four groups corresponding to the dot data items 0 to 63, 64 to 127, 128 to 191, and 192 to 255, respectively, and data determining the driving state of the nozzles during the scanning operations (i.e., which positions are to be targets of ink jet during the scanning operations) is generated in accordance with the correction factors illustrated in FIG. 5.

FIG. 7B illustrates correction factors and jet control data in correlation with the driving state of the nozzles corresponding to the correction factors.

FIGS. 8A to 8D are schematic views of the nozzles to be driven in the first to fourth scanning operations for the correction factors "1" to "4" during a drawing operation in accordance with the jet control data illustrated in FIG. 7B.

Figure 8A:
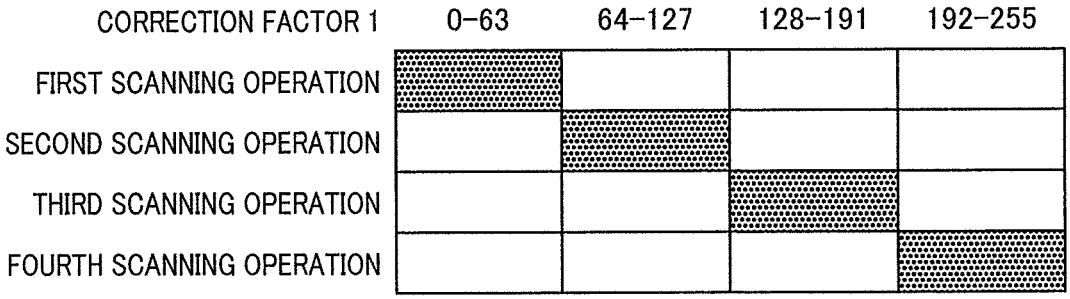
FIG. 8A illustrates example jet control during scanning at a correction factor "1.
Figure 8B:
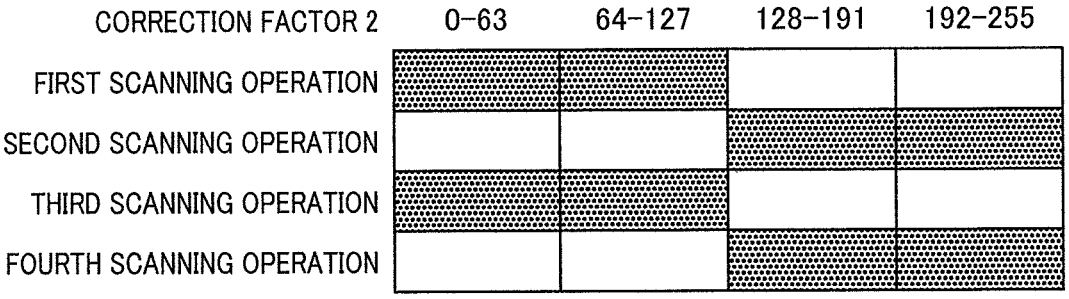
" FIG. 8B illustrates example jet control during scanning at a correction factor "2.
Figure 8C:
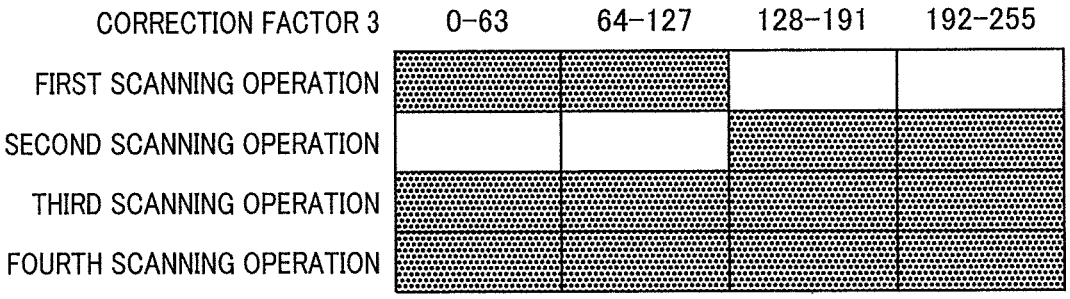
" FIG. 8C illustrates example jet control during scanning at correction factor "3.
Figure 8D:
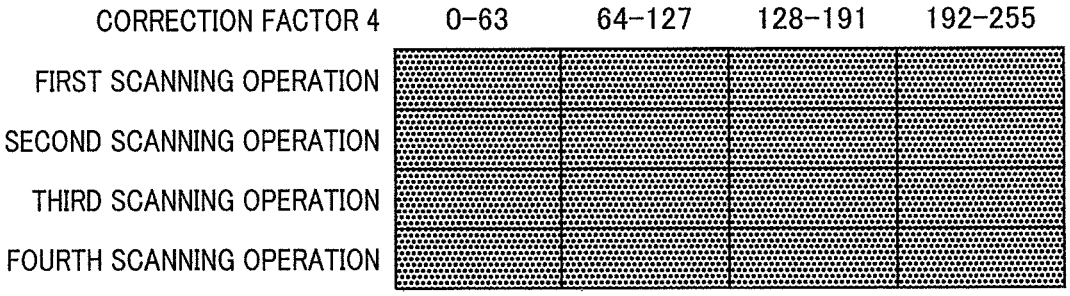
" FIG. 8D illustrates example jet control during scanning at correction factor "4."

For the correction factor "1" with no curved surface correction, the nozzles of the drawing head 41 are driven to jet ink to sequentially form the dots corresponding to each of the four categories during each of the first to fourth scanning operations, respectively, as illustrated in FIGS. 7B and 8A.

In detail, the first scanning operation drives the nozzles of the drawing head 41 to jet ink onto areas corresponding to the dot data items 0 to 63 among the dot data items 0 to 255. The second scanning operation filters the dot data items 0 to 63 that have already been printed and drives the nozzles of the drawing head 41 to jet ink onto areas corresponding to the dot data items 64 to 127. The third scanning operation filters the dot data items 0 to 127 that have already been printed and drives the nozzles of the drawing head 41 to jet ink onto areas corresponding to the dot data items 128 to 191. The fourth scanning operation filters the dot data items 0 to 191 that have already been printed and drives the nozzles of the drawing head 41 to jet ink onto areas corresponding to the dot data items 192 to 255. After the four scanning operations, ink is jetted to form all the dot data items 0 to 255, to achieve a density of 100%.

The four scanning operation completes print of all the mask patterns corresponding to the dot data items 0 to 255. In other words, ink is jetted one time from each nozzle of the drawing head 41 to each of the dots 0 to 255 in a unit region. The single drawing of the full region (100% density) is thereby achieved.

For the correction factor "2," ink is jetted once from each nozzle to form all the dots 0 to 255 by the first and second scanning operations of the drawing head 41, and further jetted once from each nozzle to form all the dots 0 to 255 by the third and fourth scanning operations of the drawing head 41. Thus, four scanning operations of the drawing head 41 jet ink two times from each nozzle to form the dots 0 to 255. The double drawing of the full region (200% density) is thereby achieved (see FIG. 88).

For the correction factor "3," ink is jetted once from each nozzle to form all the dots 0 to 255 by the first and second scanning operations of the drawing head 41, and further jetted once from each nozzle to form all the dots 0 to 255 by each of the third and fourth scanning operations of the drawing head 41. Thus, four scanning operations of the drawing head 41 jet ink three times from each nozzle to form the dots 0 to 255. The triple drawing of the full region (300% density) is thereby achieved (see FIG. 8C).

For the correction factor "4," ink is jetted once from each nozzle to form all the dots 0 to 255 by each of the first to fourth scanning operations of the drawing head 41. Thus, four scanning operations of the drawing head 41 jet ink four times from each nozzle to form the dots 0 to 255. The quadruple drawing of the full region (400% density) is thereby achieved (see FIG. 8D).

Figure 9:
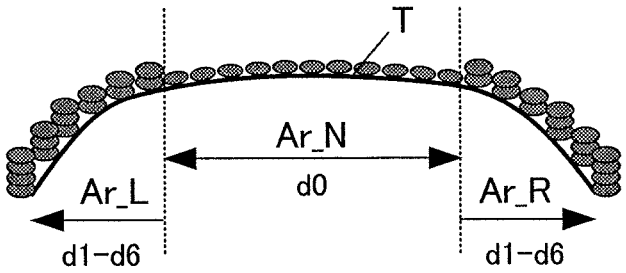
FIG. 9 is a schematic view of print density correction for drawing.

In this way, ink is jetted once from each nozzle onto the area "Ar_N," which requires no curved surface correction and has a correction factor "1," at a density of 100%, to uniformly apply an appropriate amount of ink on the nail T, as schematically illustrated in FIG. 9.

In contrast, ink is jetted four times from each nozzle onto the end regions of the nail T in the width direction having a correction factor "4," to achieve a sufficient density of 400%.

Ink is jetted two times and three times, respectively, in the areas having correction factors "2" and "3," to achieve densities of 200% and 300%. In this way, the density can be corrected in accordance with the curvatures.

Any jet control data generated in the drawing-data generating process other than that illustrated in FIG. 7B may also be used.

For example, in the case where the correction factor is "1" as illustrated in FIGS. 7A and 8A, one fourth of the dots may be printed during each scanning operation, and then different nozzles, i.e., another portion of the nozzles may be driven during each scanning operation to print another fourth of the dots.

Figure 10:
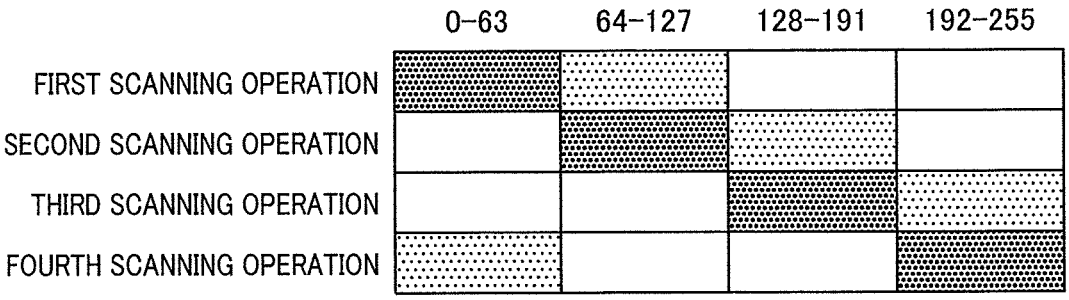
FIG. 10 illustrates jet control according to a modification.

For example, the first scanning operation prints the dots 0 to 63 and a portion of the dots 64 to 127, as illustrated in FIG. 10. Similarly, the jet control data is generated so as to control the nozzles to print the dots 64 to 127 and a portion of the dots 128 to 191 in the second scanning operation, the dots 128 to 191 and a portion of the dots 192 to 255 in the third scanning operation, and the dots 192 to 255 and a portion of the dots 0 to 63 in the fourth scanning operation.

The number of nozzles to be driven is gradually increased to linearly control the density between 100% and 200%.

In this way, the density can be linearly controlled between 200% and 300% for the areas having a correction factor "2," and between 300% and 400% for the areas having a correction factor "3".

The drawing control process executed by the processor 81 controls the drawing head 41 to scan the unit region on the target nail a plurality of times while driving all or a portion of the nozzles, and forms a pattern through multipass printing. In this embodiment, the drawing head 41 is reciprocated on the nail T four times over each unit region, to form a pattern.

The processor 81 executing the drawing control process sends a control signal to the drawing unit 40 based on the jet control data of the drawing data generated in the drawing-data generating process executed by the processor 81, and controls the X-direction shift motor 46, the Y-direction shift motor 48, and the drawing head 41 of the drawing unit 40 to print a pattern on the nail T in accordance with the drawing data.

In this embodiment, the nozzles to be driven are determined on the basis of the jet control data, and thus the drawing control process controls the driving of the nozzles of the drawing head 41 on the basis of the jet control data.

The display controlling process executed by the processor 81 controls the display 26 to present various menus on the display 26. In this embodiment, the display controlling process causes the display 26 to present, for example, a selection menu of nail designs, thumbnail images for confirming designs, nail images of a target finger U1, various instructions, and other menus.

The curvature determined for the surface of the nail T of the user may appear on the display 26, so that the user can confirm the curvature. If the user determines the curvature automatically selected by the apparatus to be inappropriate for her nail T, the curvature may be varied or finely adjusted by operating the operating unit 25 and/or the touch panel.

Figure 11:
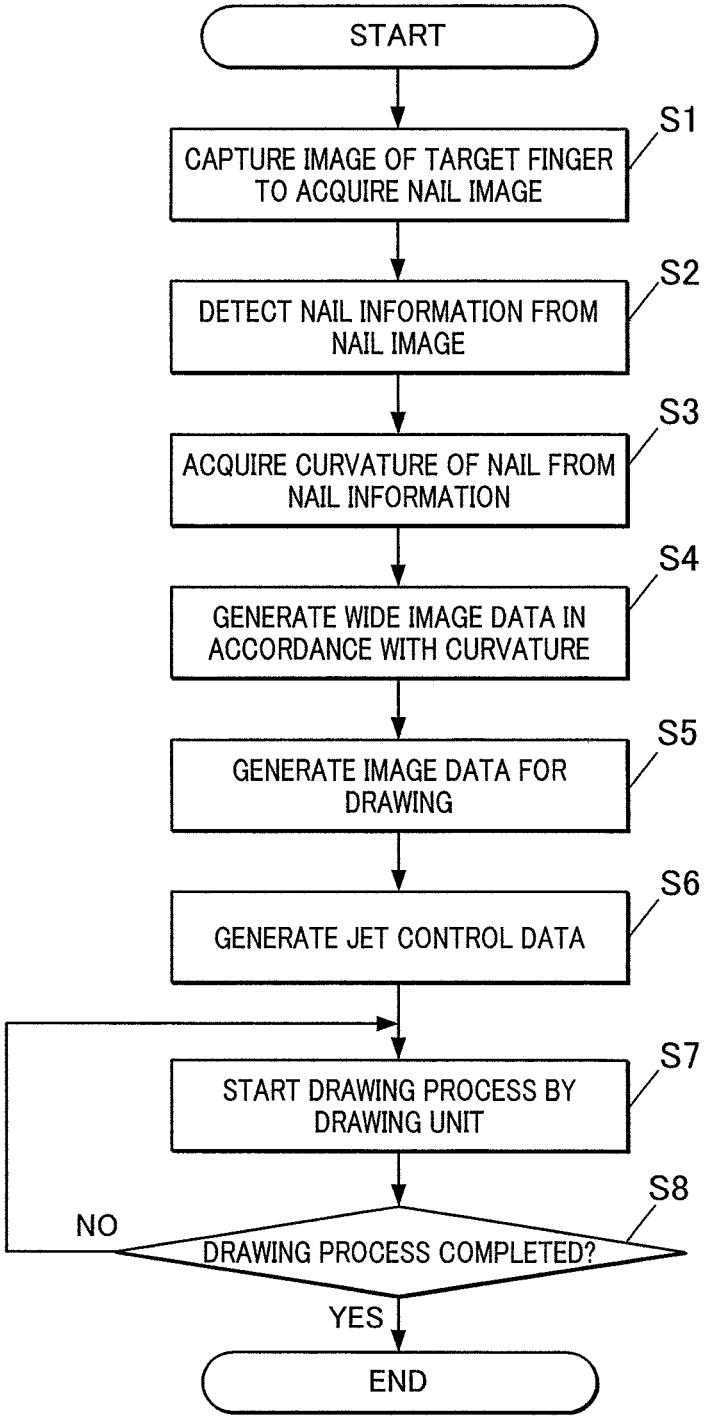
FIG. 11 is a flow chart illustrating a drawing process according to an embodiment.

A method of drawing a pattern with the nail printer 1 according to this embodiment will now be explained with reference to FIG. 11.

To draw a pattern with the nail printer 1, the user turns on the power and starts the controller 80.

In response to an input operation of a drawing switch, the processor 81 starts the imaging control process to control the image capturing unit 50 to capture an image of the target finger U1 with the image capturing device 51 while illuminating the target finger U1 with the lighting devices 52, before the drawing operation. In this way, the processor 81 acquires a nail image of the nail T of the target finger U1 (step S1).

The nail-information detecting process executed by the processor 81 acquires nail information including the outline of the nail T and the positions of the nail T in the height direction from the nail image (step S2).

The processor 81 then acquires the curvatures indicating the curvature of the target nail T in the width direction from the nail information (step S3).

After acquisition of the curvatures of the nail T, the processor 81 executes the drawing-image generating process to generate wide image data based on correction factors determined in accordance with the curvatures (step S4).

In detail, the processor 81 generates wide image data corresponding to a width larger than the width of the apparent width of the top view of the nail T, in reference to a table containing correction factors for different positions on the nail T in the width direction corresponding to the curvatures.

The processor 81 carries out shape correction by compressing the portion of the wide image data corresponding to the two end regions of the nail T in the width direction in accordance with the curvatures in reference to the table used in the generation of wide image data, and matching the compressed data to the two-dimensional shape of the nail, to generate image data for drawing (step S5).

The processor 81 generates jet control data corresponding to the image data for drawing to be used for control of the driving of the nozzles of the drawing head 41 on the basis of the correction factors corresponding to the curvatures (step S6).

The drawing-data generating process executed by the processor 81 generates the jet control data corresponding to the image data for drawing. In response, the drawing control process executed by the processor 81 controls the operation of the drawing head 41 on the basis of the jet control data and starts printing the nail design on the nail T (step S7).

In this embodiment, the printing of a unit region is completed after the drawing head 41 scans four times over the nail T. The nozzles to be driven and the positions on which ink is to be jetted during each scanning operation are controlled in accordance with the jet control data.

In the case where the surface of the target nail T consists of two or more unit regions, the same process as described above is repeated for each unit region.

The drawing control process executed by the processor 81 checks for the completion of the entire drawing process involving the nail T (step S8). If the drawing process is completed ("YES" in step S8), the drawing control process ends. If the drawing process is not completed (i.e., the four scanning operations of the drawing head is not completed or at least one imprinted unit region remain in multiple unit regions) ("NO" in step S8), the process returns to step S7.

According to the embodiment described above, a nail printer 1, which includes an inkjet drawing head 41 including multiple nozzles jetting ink and carrying out multipass printing of a pattern, acquires curvatures indicating the curvature of a nail T in the width direction, establishes jet control data for controlling the driving state of the nozzles during a plurality of scanning operations of the drawing head 41 on the basis of the curvatures of the surface of the nail T, and controls the drawing head 41 on the basis of the jet control data.

In this embodiment, the density of the printed pattern is adjusted through control of the jet of ink from the nozzles during a plurality of scanning operations. Thus, the image data of the nail design is relatively small, for example, 600 dpi. Thus, the memory storing the image (the nail-design memory area 823 in this embodiment) may have a small capacity.

The correction factors for the adjustment of the density of the pattern correspond to the curvatures of the surface of the nail T. Thus, the shape of the curved surface of the nail T can be subjected to appropriate curved surface correction, to achieve a beautiful finish on the entire nail T including the two end regions.

The drawing-data generating process generates wide image data by once expanding the length of the design data on the nail design to be printed on the nail T in the width direction in accordance with the curvatures and carries out shape correction by compressing the portion of the wide image data corresponding to the two end regions in the width direction in accordance with the curvatures and matching the compressed data to the two-dimensional shape of the nail T, to generate image data for drawing.

Shape correction for matching the image data of the nail design to the curvature of the nail prevents distortion and stretching of the design even in the two end regions of the nail in the width direction. Thus, a nail design can be drawn with a beautiful finish.

The above embodiments should not be construed to limit the present invention and may be appropriately modified within the gist of the present invention.

In the embodiment described above, the drawing-data generating process executed by the processor 81 carries out the curved surface correction including shape correction and density correction on the data of the nail design. The shape correction may be omitted. For example, in the case where the nail design includes a gradation of a plurality of colors or consists of only lines, the finish of the drawing is not greatly affected by slight distortion and/or stretching of the pattern in the end regions of the nail in the width direction. Thus, the data of such a nail design requires only density correction without shape correction.

In such a case, the drawing-data generating process generates jet control data corresponding to the image data for drawing in accordance with the correction factors corresponding to the curvatures and controls the jet of the nozzles of the drawing head 41 on the basis of the jet control data. This reduces the size of the image data on the nail design, while achieving a gradation of densities of 100% or higher in the two end regions of the nail in the width direction, through nozzle control.

In the embodiment described above, the image data on the nail design is stored in the memory 82. Alternatively, the image data on the nail design may be retrieved from, for example, an external unit via the Internet.

In such a case, image data having a large volume requires long transmission time. In the embodiment described above, the image data on the nail design has a relatively small volume of, for example, 600 dpi, because the jet ink from nozzles during a plurality of scanning operations is controlled to adjust the density of the drawn pattern. Thus, data can be smoothly transmitted and received even when the image data on the nail design is to be retrieved from an external unit.

In the embodiment described above, the drawing head 41 is of an inkjet type. Alternatively, the nail printer may include an inkjet drawing head and a drawing tool, such as a pen, both of which may be used for drawing.

The embodiments described above should not be construed to limit the present invention, and the claims and other equivalents thereof are included in the scope of the invention.

What is claimed is:

1. A drawing apparatus comprising:

a drawing head that draws a pattern on a surface of a target nail of a finger or toe by performing a plurality of scanning operations; and a processor that (i) generates wide image data by expanding nail design data to be drawn on the target nail at two end regions in a width direction of the target nail in accordance with a curvature of the target nail, (ii) generates image data for drawing by decreasing a portion of the wide image data corresponding to an area having a large curvature on the surface of the target nail in the width direction and by matching the decreased portion of the wide image data to a two-dimensional shape of the target nail, and (iii) generates jet control data that determines a driving state of the drawing head during the plurality of scanning operations of the drawing head based on the image data for drawing and the curvature of the target nail.

2. The drawing apparatus according to claim 1, wherein the drawing head comprises a plurality of inkjet nozzles that jet ink, and wherein the processor controls the drawing head to scan a plurality of times across an area on the surface of the target nail while driving at least one of the nozzles to draw the pattern, and controls a driving state of the nozzles during each of the plurality of scanning operations of the drawing head based on the curvature of the target nail.

3. The drawing apparatus according to claim 2, wherein the processor controls the nozzles such that a volume of the ink to be applied to an area of the target nail having a large curvature is greater than a volume of the ink to be applied to an area of the target nail having a small curvature when the pattern is drawn during the plurality of scanning operations of the drawing head.

4. The drawing apparatus according to claim 2, wherein the processor controls the drawing head based on the jet control data.

5. The drawing apparatus according to claim 1, wherein the two-dimensional shape of the target nail is a shape of the target nail when viewed in plan view.

6. The drawing apparatus according to claim 1, wherein the processor expands the nail design data at the two end regions by increasing a distance between adjacent data items included in the nail design data in the two end regions.

7. The drawing apparatus according to claim 6, wherein the image data for drawing is used to perform drawing on the surface of the nail by the drawing head.

8. A non-transitory readable recording medium storing a program executable by a processor of a drawing apparatus including a drawing head that draws a pattern on a surface of a target nail of a finger or toe by performing a plurality of scanning operations, the program being executable to control the processor to execute processes comprising:

generating wide image data by expanding nail design data to be drawn on the target nail at two end regions in a width direction of the target nail in accordance with a curvature of the target nail;

generating image data for drawing by decreasing a portion of the wide image data corresponding to an area having a large curvature on the surface of the target nail in the width direction and by matching the decreased portion of the wide image data to a two-dimensional shape of the target nail; and generating jet control data that determines a driving state of the drawing head during the plurality of scanning operations of the drawing head based on the image data for drawing and the curvature of the target nail.

* * * * *